US010056689B2

(12) United States Patent
Lee

(10) Patent No.: US 10,056,689 B2
(45) Date of Patent: Aug. 21, 2018

(54) ELECTRONICALLY STEERABLE PARASITIC RADIATOR ANTENNA AND BEAM FORMING APPARATUS

(71) Applicant: Electronics and Telecommunications Research Institute, Daejeon (KR)

(72) Inventor: Jung Nam Lee, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 322 days.

(21) Appl. No.: 15/158,147

(22) Filed: May 18, 2016

(65) Prior Publication Data

US 2016/0365632 A1 Dec. 15, 2016

(30) Foreign Application Priority Data

Jun. 9, 2015 (KR) ..... 10-2015-0081061
Jun. 9, 2015 (KR) ..... 10-2015-0081062
Jun. 10, 2015 (KR) ..... 10-2015-0082049
Jun. 11, 2015 (KR) ..... 10-2015-0082433
Nov. 23, 2015 (KR) ..... 10-2015-0164241

(51) Int. Cl.
*H01Q 9/04* (2006.01)
*H01Q 3/44* (2006.01)

(52) U.S. Cl.
CPC ..... *H01Q 9/0442* (2013.01); *H01Q 3/446* (2013.01)

(58) Field of Classification Search
CPC ..... H01Q 9/0442; H01Q 3/446; H01Q 3/26; H01Q 3/267; H01Q 3/2676
USPC ..... 342/368
See application file for complete search history.

(56) References Cited

U.S. PATENT DOCUMENTS 8,982,008 B2 3/2015 Parsche
2002/0158798 A1* 10/2002 Chiang ..... H01Q 3/446 342/372
2003/0048223 A1* 3/2003 Kezys ..... H01Q 3/26 342/368

(Continued)

FOREIGN PATENT DOCUMENTS

KR 10-2010-0082295 A 7/2010
KR 10-2015-0062734 A 6/2015

OTHER PUBLICATIONS

Biao Li, et al., "Wideband Dual-Polarized Patch Antenna With Low Cross Polarization and High Isolation," IEEE Antennas and Wireless Propagation, Letters, vol. 11: 427-430 (2012).

(Continued)

*Primary Examiner* — Harry K Liu
(74) *Attorney, Agent, or Firm* — Nelson Mullins Riley & Scarborough LLP

(57) ABSTRACT

Provided are an electronically steerable parasitic radiator antenna and a beam forming apparatus. The ESPAR antenna includes: an active patch radiator disposed at the center of one surface of a substrate to radiate a beam corresponding to a signal applied through a feeding line; a plurality of parasitic patch elements disposed to have a predetermined angle in different directions, respectively based on a central position of the active patch radiator to derive the beam radiated by the active patch radiator in a predetermined direction; and a reactance element disposed between the active patch radiator and the plurality of parasitic patch elements to determine a direction of the beam radiated by the active patch radiator.

15 Claims, 6 Drawing Sheets

(56) References Cited

U.S. PATENT DOCUMENTS

| | | | | |
|---|---|---|---|---|
| 2006/0145926 | A1 | 7/2006 | Choi et al. | |
| 2009/0224991 | A1* | 9/2009 | Rowson | H01Q 1/243 343/747 |
| 2009/0309799 | A1* | 12/2009 | Hossain | H01Q 3/44 343/754 |
| 2010/0277370 | A1 | 11/2010 | Park et al. | |
| 2011/0298551 | A1* | 12/2011 | Yen | H01L 27/016 331/117 FE |
| 2015/0340770 | A1* | 11/2015 | Loh | H01Q 3/30 343/833 |

OTHER PUBLICATIONS

Schlub, R. et al., "Practical Realization of Switched and Adaptive Parasitic Monopole Radiating Structures," Chapter 6, The ESPAR Antenna, 36 pages (2004) https://www120.secure.griffith.edu.au/rch/items/f315afdf-830a-91eb-abdf-b1df868d1ecc/1/ pp. 91-124.

Schlub, R. et al., "Seven-Element Ground Skirt Monopole ESPAR Antenna Design From a Genetic Algorithm and the Finite Element Method," IEEE Transactions on Antennas and Propagation, vol. 51 (11): 3033-3039 (Nov. 2003).

Sharma, S. et al., "Planar Yagi-Uda Antenna with Reconfigurable Radiation Patterns," Microwave and Optical Technology Letters, vol. 55 (12): 2946-2952 (Dec. 2013).

Sun, C. et al., "Fast Beamforming of Electronically Steerable Parasitic Array Radiator Antennas: Theory and Experiment," IEEE Transactions on Antennas and Propagation, vol. 52 (7):1819-1832 (Jul. 2004).

Zhang, S. et al., "Three Variations of a Pattern Reconfigurable Microstrip Parasitic Array," Microwave and Optical Technology Letters, vol. 45 (5):369-372 (Jun. 5, 2005).

Zhou, Y. et al., "Design and Evaluation of Pattern Reconfigurable Antennas for MIMO Applications," IEEE Transactions on Antennas and Propagation, vol. 62 (3): 1084-1092 (Mar. 2014).

* cited by examiner

[FIG.1]
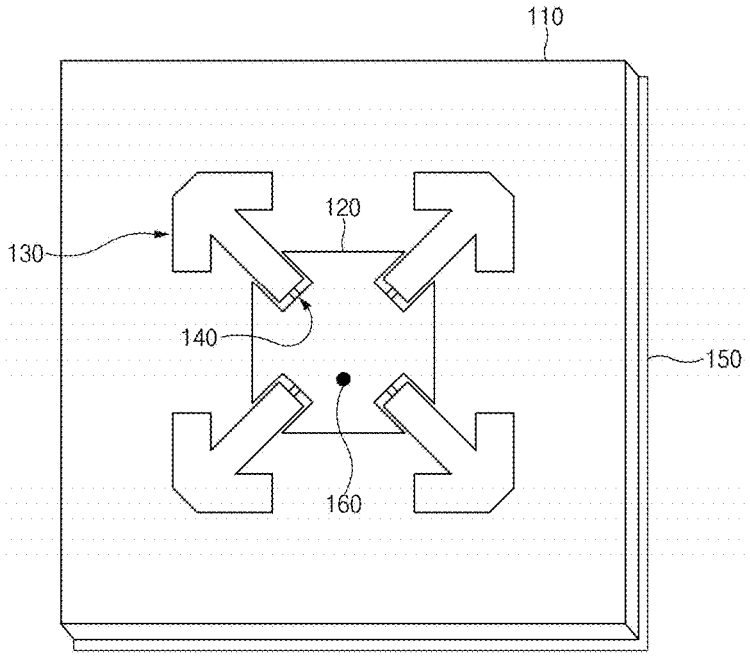
[FIG.2]
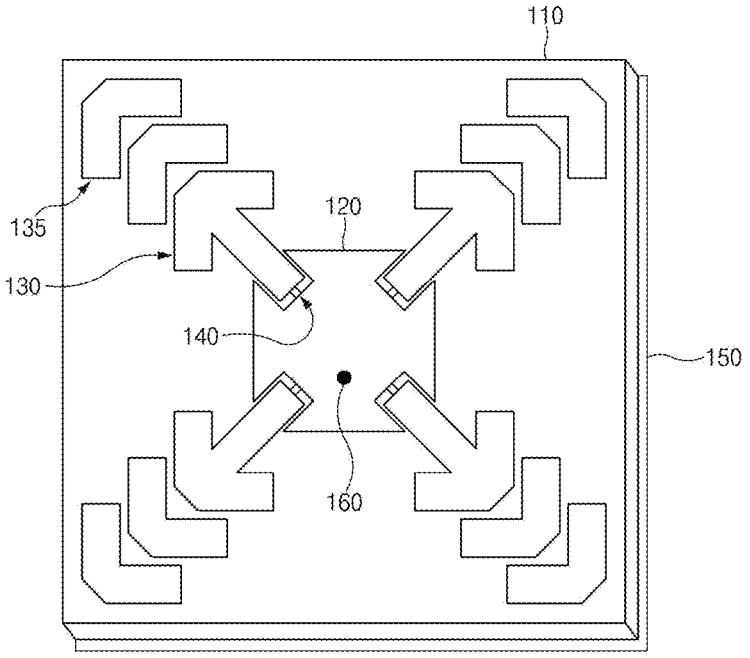

[FIG.3]
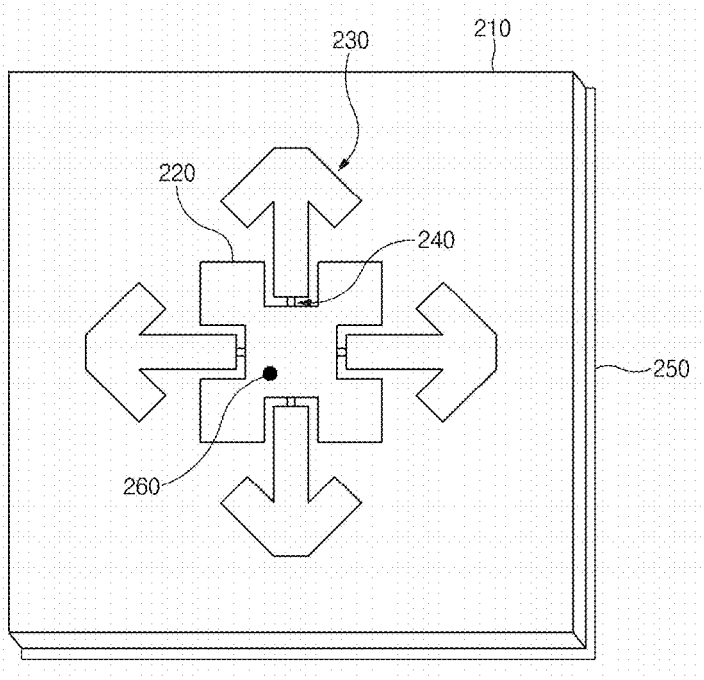
[FIG.4]
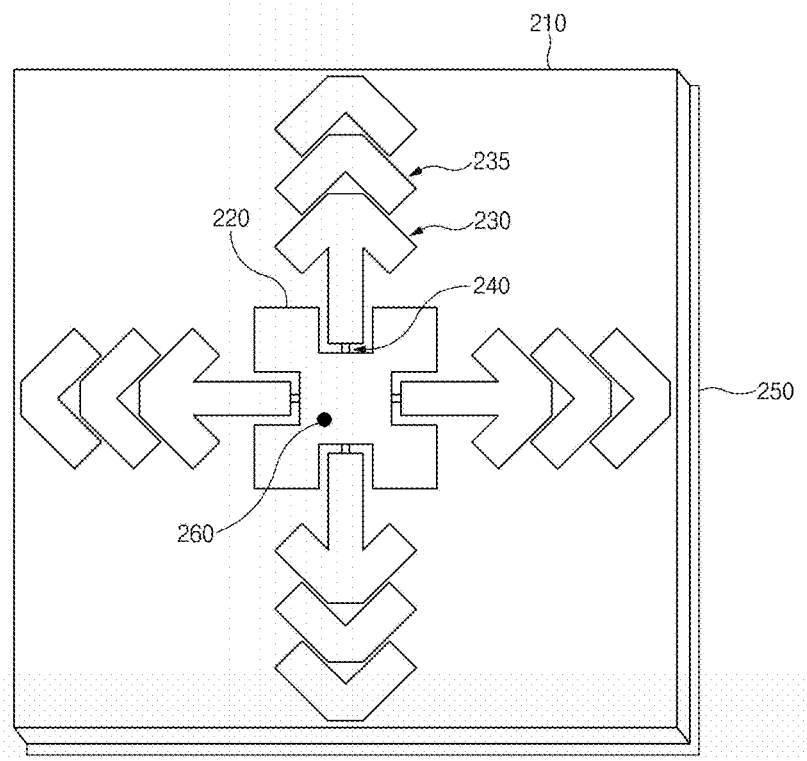

[FIG.5]
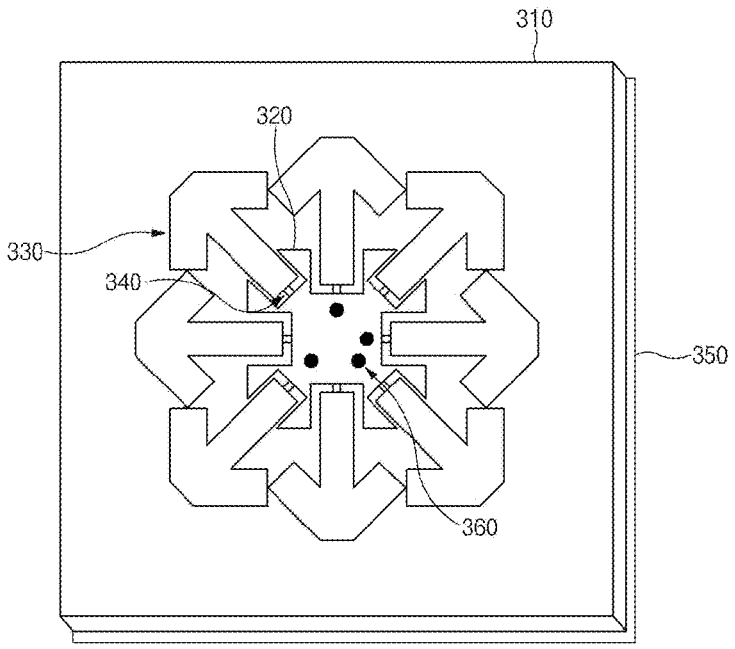
[FIG.6]
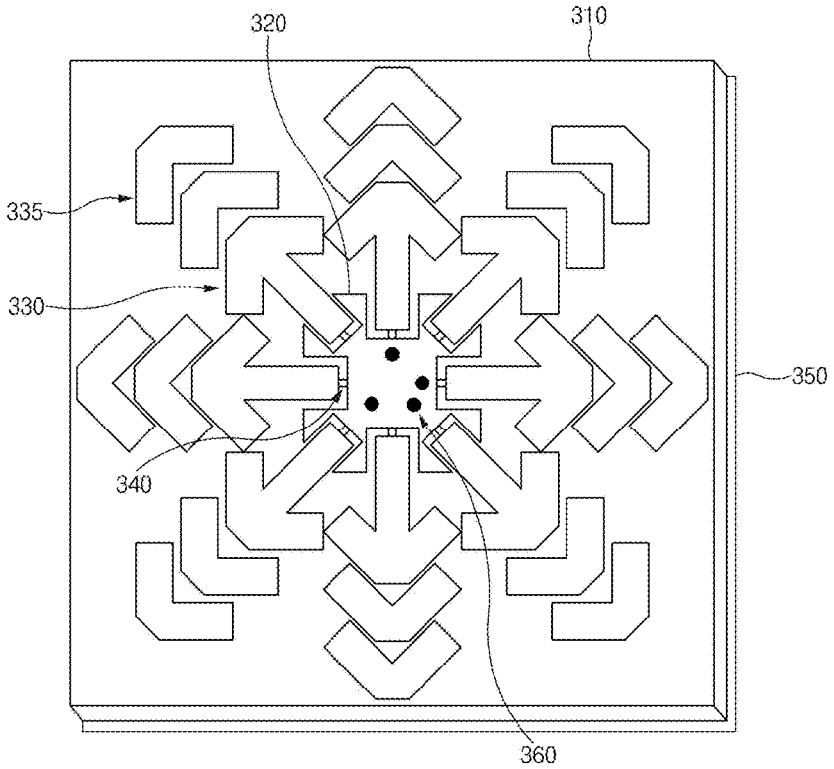

[FIG.7]
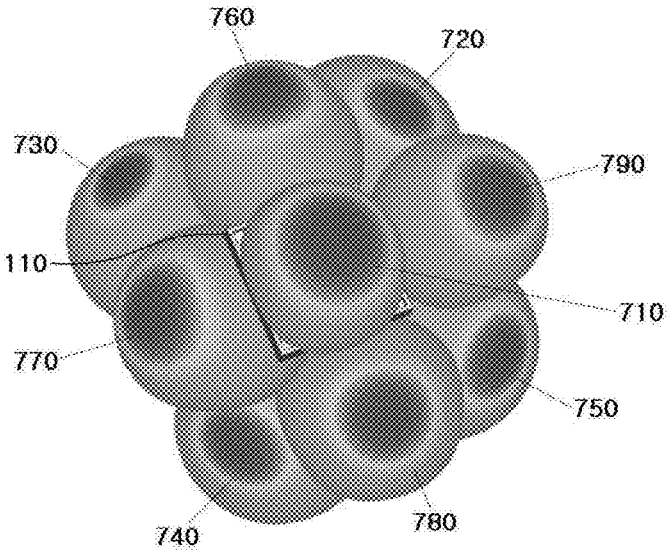
[FIG.8]
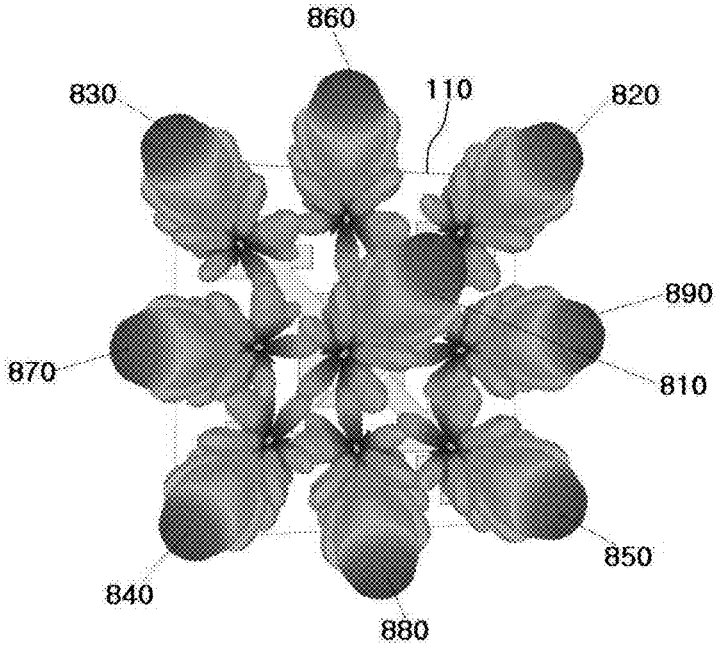

[FIG.9]
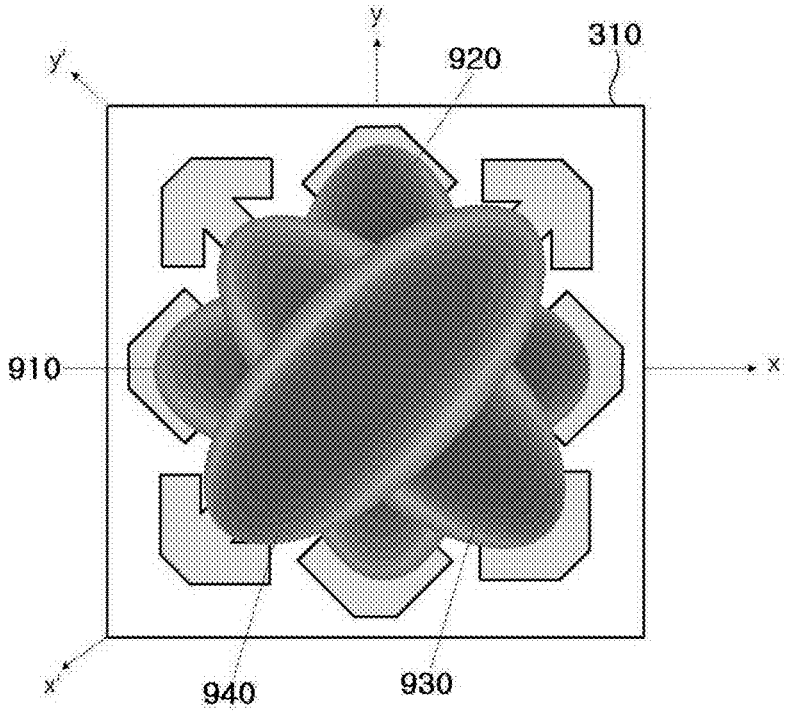

[FIG.10]
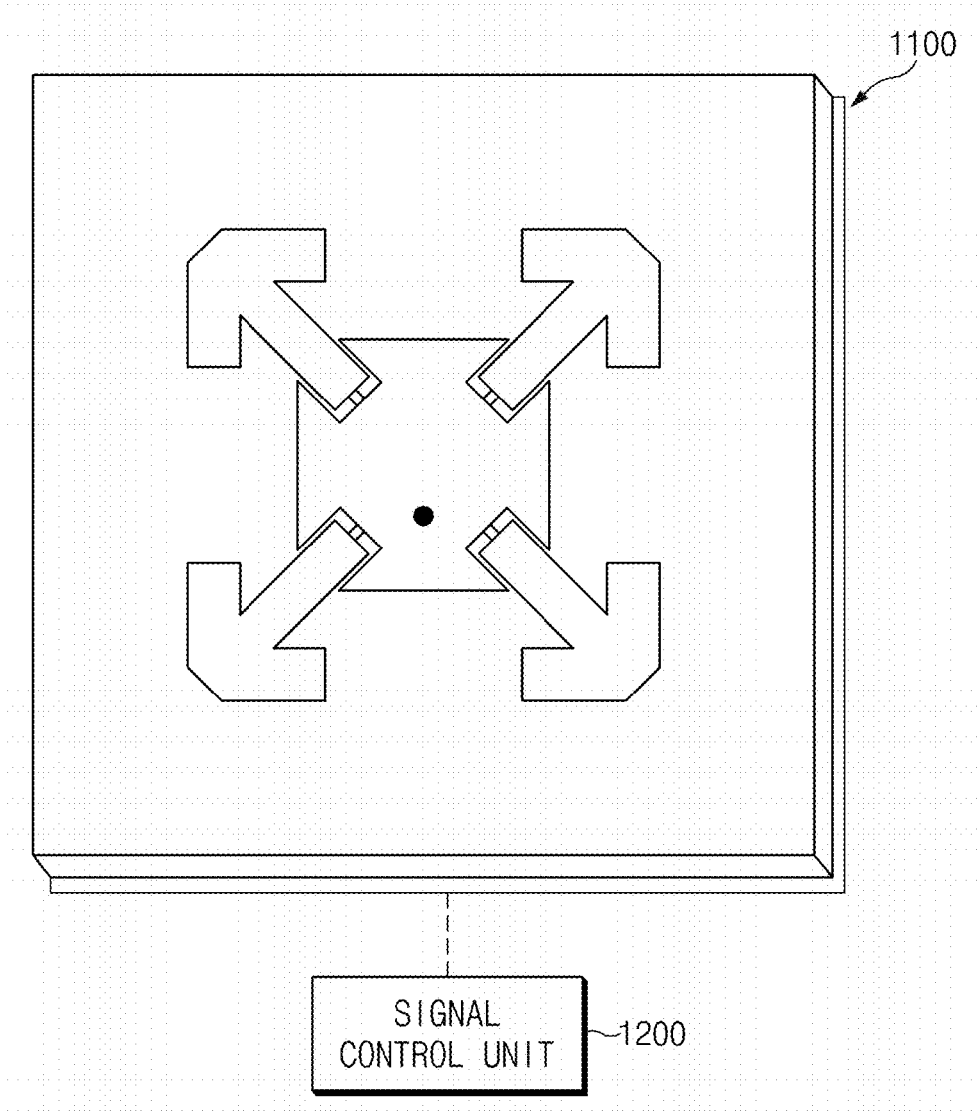

ELECTRONICALLY STEERABLE PARASITIC RADIATOR ANTENNA AND BEAM FORMING APPARATUS

CROSS-REFERENCE TO RELATED APPLICATIONS

This application claims priority to and the benefit of Korean Patent Application No. 10-2015-0081061 filed in the Korean Intellectual Property Office on Jun. 9, 2015, Korean Patent Application No. 10-2015-0081062 filed in the Korean Intellectual Property Office on Jun. 9, 2015, Korean Patent Application No. 10-2015-0082049 filed in the Korean Intellectual Property Office on Jun. 10, 2015, Korean Patent Application No. 10-2015-0082433 filed in the Korean Intellectual Property Office on Jun. 11, 2015 and Korean Patent Application No. 10-2015-0164241 filed in the Korean Intellectual Property Office on Nov. 23, 2015, the entire contents of which are incorporated herein by reference.

TECHNICAL FIELD

The present invention relates to an electronically steerable parasitic radiator antenna and a beam forming apparatus.

BACKGROUND ART

In recent years, a research into a technology of smart antennas such as an adaptive antenna and a digital beam forming apparatus has been in progress.

A phase array antenna can control beam steering by using a phase shifter. However, since a price of the phase shifter is high, cost of an antenna increases. To this end, proposed is an electronically steerable parasitic radiator (ESPAR) antenna which can perform beam steering by only a manual parasitic element without requiring the phase shifter.

In general, the ESPAR antenna uses a di-pole, mono-pole, or patch-structure antenna and in the case of the di-pole-structure ESPAR antenna, a total length of the di-pole antenna is large and in the case of the mono-pole-structure ESPAR antenna, a length of the mono-pole antenna is two times smaller than the di-pole antenna, but the mono-pole antenna has a larger ground plane than the di-pole antenna. The patch-structure ESPAR antenna can be still smaller in vertical size of the antenna than the di-pole antenna and the mono-pole antenna. The patch antenna is smaller in bandwidth of the antenna and in gain than the di-pole antenna and the mono-pole antenna. Further, in the patch antenna, a horizontal size of the antenna can increase.

SUMMARY OF THE INVENTION

The present invention has been made in an effort to provide an ESPAR antenna capable of achieving miniaturization of an ESPAR antenna having wide extendibility and a beam forming apparatus using the same.

The technical objects of the present invention are not limited to the aforementioned technical objects, and other technical objects, which are not mentioned above, will be apparently appreciated to a person having ordinary skill in the art from the following description.

An exemplary embodiment of the present invention provides an ES PAR antenna including: an active patch radiator disposed at the center of one surface of a substrate to radiate a beam corresponding to a signal applied through a feeding line; a plurality of parasitic patch elements disposed to have a predetermined angle in different directions, respectively, based on a central position of the active patch radiator to derive the beam radiated by the active patch radiator in a predetermined direction; and a reactance element disposed between the active patch radiator and the plurality of parasitic patch elements to determine a direction of the beam radiated by the active patch radiator.

Herein, the plurality of parasitic patch elements may be disposed to be inserted into a central direction of the active patch radiator from the outside of the active patch radiator.

In the active patch radiator, a slit into which a part of each parasitic patch element is inserted may be formed at a partial area of a periphery forming an exterior of the active patch radiator.

The slit may be formed to be wider than the exterior of the partial parasitic patch element inserted into the partial area of the periphery forming the exterior of the active patch radiator.

The plurality of parasitic patch elements may be inserted to be spaced apart from each slit formed at the partial area of the periphery forming the exterior of the active patch radiator by a predetermined interval.

The reactance element may include a reactance variable circuit, and the active patch radiator may radiate the beam in a direction in which a parasitic patch element connected with any one reactance element in which a reactance value of the reactance variable circuit varies among a plurality of reactance elements is positioned.

The reactance element may include the reactance variable circuit, and the active patch radiator may radiate the beam in any one direction between parasitic patch elements connected with at least two reactance elements in which the reactance value of the reactance variable circuit varies among the plurality of reactance elements.

The parasitic patch element connected with the reactance element in which the reactance value of the reactance variable circuit varies among the plurality of parasitic patch elements may operate as a derivative and the residual parasitic patch elements may operate as a reflector.

The plurality of parasitic patch elements may be disposed at a position where a distance between the central position of each parasitic patch element and the central position of the active patch radiator becomes any one of $\lambda/32$ to $\lambda/4$ of an operating frequency of the corresponding antenna.

In the plurality of parasitic patch elements, patches having a partial shape of the corresponding parasitic patch element may be repeatedly arrayed based on a predetermined direction.

In the active patch radiator, the feeding line may be vertically connected on a line connecting two parasitic patch elements disposed to face each other based on the central position of the active patch radiator and when the signal is applied through the feeding line, a polarized beam pattern may be formed based on a direction which both ends of the line connecting two parasitic patch elements face.

In the active patch radiator, the feeding line may be vertically connected to two lines which are orthogonal to each other among lines connecting two parasitic patch elements disposed to face each other based on the central position of the active patch radiator and when the signal is applied through the feeding line connected to the two lines, a dual polarized beam pattern may be formed based on directions which both ends of each line face.

The plurality of parasitic patch elements may be disposed in two or more directions facing each other, respectively, based on the central position of the active patch radiator.

The active patch radiator may be implemented in any one shape of circular and polygonal shapes.

The plurality of parasitic patch elements may be implemented in any one shape of an arrow, an oval, a rectangle, and the polygonal shape other the rectangular shape.

Meanwhile, another exemplary embodiment of the present invention provides a beam forming apparatus including: an ESPAR antenna including an active patch radiator, a plurality of parasitic patch elements and a plurality of reactance elements and radiating a beam corresponding to a signal applied through a feeding line and a signal control unit controlling a pattern of a beam radiated by the ESPAR antenna by controlling a reactance value of at least one reactance element and an on or off operation of at least one parasitic patch element.

According to exemplary embodiments of the present invention, an ESPAR antenna can be minimized and a beam direction can be easily adjusted according to a change in reactance value and an array of parasitic patch elements is differently implemented to increase a gain of an antenna.

It is also advantageous in that a dual polarized antenna is configured by configuring double feeding.

The exemplary embodiments of the present invention are illustrative only, and various modifications, changes, substitutions, and additions may be made without departing from the technical spirit and scope of the appended claims by those skilled in the art, and it will be appreciated that the modifications and changes are included in the appended claims.

BRIEF DESCRIPTION OF THE DRAWINGS

FIG. 1 is a diagram illustrating a configuration of an ESPAR antenna according to the present invention.

FIG. 2 is a diagram illustrating a modified exemplary embodiment of the ESPAR antenna according to the present invention.

FIG. 3 is a diagram illustrating another exemplary embodiment of FIG. 1.

FIG. 4 is a diagram illustrating a modified exemplary embodiment of FIG. 3.

FIG. 5 is a diagram illustrating yet another exemplary embodiment of FIG. 1.

FIG. 6 is a diagram illustrating a modified exemplary embodiment of FIG. 5.

FIG. 7 is a diagram illustrating a beam pattern of the ESPAR antenna corresponding to FIGS. 1 and 3.

FIG. 8 is a diagram illustrating a beam pattern of the ESPAR antenna corresponding to FIGS. 2 and 4.

FIG. 9 is a diagram illustrating a beam pattern of the ESPAR antenna corresponding to FIG. 5.

FIG. 10 is a diagram illustrating a configuration of a beam forming apparatus to which the ESPAR antenna according to the present invention is applied.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Hereinafter, some exemplary embodiments of the present invention will be described in detail with reference to the exemplary drawings. When reference numerals refer to components of each drawing, it is noted that although the same components are illustrated in different drawings, the same components are designated by the same reference numerals as possible. In describing the exemplary embodiments of the present invention, when it is determined that the detailed description of the known components and functions related to the present invention may obscure understanding of the exemplary embodiments of the present invention, the detailed description thereof will be omitted.

Terms such as first, second, A, B, (a), (b), and the like may be used in describing the components of the exemplary embodiments of the present invention. The terms are only used to distinguish a component from another component, but nature or an order of the component is not limited by the terms. Further, if it is not contrarily defined, all terms used herein including technological or scientific terms have the same meanings as those generally understood by a person with ordinary skill in the art. Terms which are defined in a generally used dictionary should be interpreted to have the same meaning as the meaning in the context of the related art, and are not interpreted as ideal or excessively formal meanings unless clearly defined in the present application.

In describing the exemplary embodiments of the present invention, a case in which an element is formed "on/under" each layer includes both a case in which the element is formed directly on/under and a case in which the element is indirectly formed with another layer interposed therebetween. When it is mentioned that one element or layer is "connected", "coupled", or "adjacent to" another element or layer, it will be well appreciated that the one element or layer may be directly connected, coupled, or adjacent to another element or layer or an element or layer interposed therebetween may be present.

An electronically steerable parasitic radiator (ESPAR) antenna according to the present invention is an antenna which is beam-steerable by using only a passive parasitic element without a phase shifter and in an embodiment of the present invention, the ESPAR antenna is implemented in the form of a patch antenna.

An ESPAR antenna illustrated in FIG. 1 shows a structure in which parasitic patch elements are disposed at four edges of a square active patch radiator, respectively, to steer a beam.

As illustrated in FIG. 1, the ESPAR antenna according to the present invention may include an active patch radiator 120, a parasitic patch element 130, a reactance element 140, and a feeding unit 160. The active patch radiator 120, the parasitic patch element 130, and the reactance element 140 may be disposed on one surface of a substrate. In this case, the active patch radiator 120, the parasitic patch element 130, and the reactance element 140 may be implemented integrally with the substrate. Herein, the substrate 110 may be a substrate made of a dielectric.

The active patch radiator 120 serves to radiate an applied signal. In this case, one area of the active patch radiator 120 is vertically connected with the feeding unit 160. The feeding unit 160 applies a signal to the active patch radiator 120 through a feeding line connected with a ground plane 150 and the active patch radiator 120 radiates the signal applied from the feeding unit 160 to the outside.

The active patch radiator 120 may be disposed at the center of one surface of the substrate. Further, the size of the active patch radiator 120 may vary depending on an operating frequency and the shape of the active patch radiator 120 may be implemented in various shapes such as a circular shape or a polygonal shape. However, in the exemplary embodiment of the present invention, for easy description, it is described as an example that the active patch radiator 120 is implemented in a square shape, but the present invention is not limited thereto.

A plurality of parasitic patch elements 130 may be disposed to be inserted in a central direction of the active patch radiator 120 from the outside of the active patch radiator 120. To this end, in the active patch radiator 120, a groove-shaped slit for disposing the parasitic patch element 130 may be formed at a partial area of a periphery forming an exterior of the active patch radiator 120.

The slit may be formed to have the same shape as a partial shape disposed to be inserted into a partial area of the periphery forming the exterior of the active patch radiator 120 among all shapes of the parasitic patch element 130. In this case, the slit is formed to be wider than the parasitic patch element 130 inserted into the partial area of the periphery forming the exterior of the active patch radiator 120.

The slit may be formed in each direction in which the parasitic patch element 130 is disposed based on a central position of the active patch radiator 120.

As an example, the slit may be formed on each of the peripheries in top left, top right, bottom left, and bottom right-directions of the central position of the active patch radiator based on the central position of the active patch radiator 120. When the active patch radiator 120 has the square shape, the slits may be formed at four edges forming the square shape.

Meanwhile, the slit may be formed on each of the top, bottom, left, and right-direction peripheries of the active patch radiator 120 based on the central position of the active patch radiator 120. Of course, the slit may be formed on each of the top, bottom, left, and right-direction peripheries of the active patch radiator 120 and the top left, top right, bottom left, and bottom right-direction peripheries of the active patch radiator based on the central position of the active patch radiator 120.

Herein, the respective slits may be formed on the periphery forming the exterior of the active patch radiator 120 to have a predetermined interval.

The parasitic patch element 130 is disposed on one surface of the substrate similarly to the active patch radiator 120 and connected with the active patch radiator 120 by the reactance element 140 on the substrate.

The reactance element 140 may include a reactance variable circuit and in this case, in a signal radiated by the active patch radiator 120, a beam direction is determined according to a change in reactance value of the reactance variable circuit. As an example, when the reactance value of the reactance element 140 connected with any one among the parasitic patch elements 130 varies, the beam radiated by the active patch radiator 120 may be radiated in a direction in which the corresponding reactance element 140 is disposed. Herein, the reactance value of the reactance variable circuit may be controlled by a control means (not illustrated).

The plurality of parasitic patch elements 130 may be disposed on one surface of the substrate and the plurality of parasitic patch elements 130 may be disposed to have a predetermined angle with each other in different directions based on the central position of the active patch radiator 120.

As an example, the plurality of parasitic patch elements 130 may be disposed to be adjacent to peripheries in the top left, top right, bottom left, and bottom right-directions of the active patch radiator based on the central position of the active patch radiator 120 as illustrated in FIGS. 1 and 2.

As described above, the plurality of parasitic patch elements 130 may be disposed in a plurality of different directions, respectively, and the directions are not limited to any one.

The plurality of parasitic patch elements 130 may be disposed to have a predetermined distance with the active patch radiator 120. Herein, a distance between the central position of each parasitic patch element 130 and the central position of the active patch radiator 120 becomes any one of $\lambda/32$ to $\lambda/4$ of an operating frequency of the corresponding antenna.

A part of each parasitic patch element 130 may be disposed to be inserted into the slit formed on the periphery of the active patch radiator 120. In this case, the partial area of the parasitic patch element 130 is inserted in the central direction of the active patch radiator 120 to reduce the size of the antenna.

Herein, the parasitic patch element 130 is disposed to be spaced apart from the periphery of the slit by a predetermined interval without contacting the periphery of the slit. In this case, the reactance element 140 including the reactance variable circuit is disposed between each parasitic patch element 130 and the active path radiator 120. The reactance element 140 may be disposed at an area close to the central position of the active patch radiator 120 among areas between the parasitic patch elements 130 and the active patch radiator 120.

When the beam direction is determined by at least one of the reactance elements 140 disposed between the respective parasitic patch elements 130 and the active patch radiator 120, each parasitic patch element 130 serves as a derivative or reflector so as to radiate the beam in the corresponding direction. In this case, the parasitic patch elements 130 may operate as the derivative or reflector according to an on/off state of a switch connected with a DC voltage terminal.

As an example, when as a direction of a first reactance element 140 is determined as the beam direction with a variation in reactance value of the first reactance element 140 among the reactance elements 140, the parasitic patch element 130 connected with the first reactance element 140 is switched off to serve as the derivative that derives the beam radiated by the active patch radiator 120 in the corresponding direction. Meanwhile, parasitic patch elements 130 connected with residual reactance elements 140 other than the first reactance element 140 are switched on to serve as the reflector that reflects the beam radiated by the active patch radiator 120 in the corresponding direction.

Herein, the on/off state of the switch connected with the DC voltage terminal may be controlled by the control means (not illustrated).

The parasitic patch element 130 may be implemented in a shape different from the active patch radiator 120. In the exemplary embodiment of the present invention, it is described as the exemplary embodiment that the parasitic patch element 130 is implemented in an arrow shape, but the present invention is not limited thereto and it is natural that the parasitic patch element 130 may be implemented in various shapes including an oval shape, the rectangular shape, and a polygonal shape other than the rectangular shape.

Meanwhile, FIG. 2 illustrates a modified exemplary embodiment of the ESPAR antenna illustrated in FIG. 1.

As illustrated in FIG. 2, the ESPAR antenna having the modified form has the same structure as the ESPAR antenna of FIG. 1. Therefore, duplicative description of the same structure and the same function of the same component will be omitted.

In this case, in the ESPAR antenna having the modified form, patches 135 having a partial shape of the parasitic patch element 130, for example, the arrow shape of an arrow are repeatedly arrayed in a predetermined direction. In this case, in the modified ESPAR antenna, an antenna gain may be increased by repeatedly arraying the arrow-shaped patches 135.

FIG. 3 illustrates another exemplary embodiment of the ESPAR antenna illustrated in FIG. 1.

In the ESPAR antenna illustrated in FIG. 1, the parasitic patch elements 130 are disposed at four corners of a square active patch radiation plate, respectively, while the ESPAR antenna illustrated in FIG. 3 shows a structure in which parasitic patch elements 230 are disposed in top, bottom, left, and right directions of the square active patch radiation plate, respectively, to steer the beam.

The ESPAR antenna illustrated in FIG. 3 is different from the ESPAR antenna illustrated in FIG. 1 only in a position where the slit is formed in an active patch radiator 220 and positions where the parasitic patch elements 230 are disposed but are the same as the ESPAR antenna illustrated in FIG. 1 in functions and layout structures of the active patch radiator 220, the parasitic patch element 230, a reactance element 240, and a feeding unit 260. Therefore, duplicative description of the same structure and the same function of the same component will be omitted.

FIG. 4 illustrates a modified exemplary embodiment of the ESPAR antenna illustrated in FIG. 3.

As illustrated in FIG. 4, the ESPAR antenna having the modified form has the same structure as the ESPAR antenna of FIG. 3. Therefore, the duplicative description of the same structure and the same function of the same component will be omitted.

In this case, in the ESPAR antenna having the modified form, patches 235 having a partial shape of the parasitic patch element 230, for example, the arrow shape of the arrow are repeatedly arrayed in a predetermined direction. In this case, in the modified ESPAR antenna, the antenna gain may be increased by repeatedly arraying the arrow-shaped patches 235.

Meanwhile, FIG. 5 illustrates yet another exemplary embodiment of the ESPAR antenna illustrated in FIG. 1. The ESPAR antenna illustrated in FIG. 5 shows a structure in which parasitic patch elements 330 are disposed in the top, bottom, left, and right directions and the top left, the top right, bottom left, and bottom right directions of the square active patch radiation plate to steer the beam.

The ESPAR antenna illustrated in FIG. 5 is different from the ESPAR antenna illustrated in FIGS. 1 and 3 only in a position where the slit is formed in an active patch radiator 220, the number of slits and positions where the parasitic patch elements 330 are disposed and the number of parasitic patch elements 330 except for a feeding unit 360 but are the same as the ESPAR antenna illustrated in FIG. 1 in layout structures of an active patch radiator 320, the parasitic patch element 330, and a reactance element 340. Therefore, the duplicative description of the same structure and the same function of the same component will be omitted.

Meanwhile, the ESPAR antenna illustrated in FIG. 5 has a double polarized antenna structure in which feeding is vertically connected onto two lines which are orthogonal to each other to form vertical and horizontal polarized waves.

In the exemplary embodiment of FIG. 5, it is illustrated that four feeding units 360 are connected to the active patch radiator 320, but feeding is performed by selecting two feeding units 360 which are orthogonal to each other to implement the dual polarized antenna according to the exemplary embodiment.

FIG. 6 illustrates a modified exemplary embodiment of the ESPAR antenna illustrated in FIG. 5.

As illustrated in FIG. 6, the ESPAR antenna having the modified form has the same structure as the ESPAR antenna of FIG. 5. In this case, in the ESPAR antenna having the modified form, patches 335 having a partial shape of the parasitic patch element 330, for example, the arrow shape of the arrow are repeatedly arrayed in a predetermined direction. In this case, in the modified ESPAR antenna, an antenna gain may be increased by repeatedly arraying the arrow-shaped patches 335.

The ESPAR antenna illustrated in FIGS. 1 to 5 may have a beam pattern illustrated in FIGS. 7 to 9.

FIG. 7 is a diagram illustrating a beam pattern of the ESPAR antenna corresponding to FIGS. 1 and 3. When all reactance values of the plurality of reactance elements are the same as each other on the substrate 110 of the ESPAR antenna of FIGS. 1 and 3, the beam pattern is formed toward the active patch radiator like reference numeral 710.

In the ESPAR antenna of FIG. 1, when the reactance value of the reactance element connected with the top right-direction parasitic patch element varies, the beam pattern is formed toward the corresponding parasitic patch element like reference numeral 720 of FIG. 7. Further, in the ESPAR antenna of FIG. 1, when the reactance value of the reactance element connected with the top left, bottom left, or bottom right-direction parasitic patch element varies, the beam pattern is formed toward the corresponding parasitic patch element like reference numeral 730, 740, or 750 of FIG. 7.

Herein, in the ESPAR antenna of FIG. 1, when both reactance values of two reactance elements connected with the top left and top right-direction parasitic patch elements vary, the beam pattern is formed in a direction between both parasitic patch elements like reference numeral 760 of FIG. 7. By such a method, in the ESPAR antenna of FIG. 1, the beam pattern may be formed in the bottom, left, or right direction like reference numeral 770, 780, or 790 of FIG. 7 by the variation of the reactance value of each reactance element connected with two parasitic patch elements.

In the ESPAR antenna of FIG. 3, when the reactance value of the reactance element connected with the top-direction parasitic patch element varies, the beam pattern is formed toward the corresponding parasitic patch element like reference numeral 760 of FIG. 7. Further, in the ESPAR antenna of FIG. 3, when the reactance value of the reactance element connected with the left, bottom, or right-direction parasitic patch element varies, the beam pattern is formed toward the corresponding parasitic patch element like reference numeral 770, 780, or 790 of FIG. 7.

Herein, in the ESPAR antenna of FIG. 3, when both reactance values of two reactance elements connected with the top and right-direction parasitic patch elements vary, the beam pattern is formed in the direction between both parasitic patch elements like reference numeral 720 of FIG. 7. By such a method, in the ESPAR antenna of FIG. 3, the beam pattern may be formed in the top-left, bottom-left, or bottom-right direction like reference numeral 730, 740, or 750 of FIG. 7 by the variation of the reactance value of each reactance element connected with two parasitic patch elements.

FIG. 8 is a diagram illustrating a beam pattern of the ESPAR antenna corresponding to FIGS. 2 and 4.

The beam pattern illustrated in FIG. 8 may be formed toward the active patch radiator like reference numeral 810 when all reactance values of the plurality of reactance elements are the same as each other on the substrate 110 similarly to the beam pattern illustrated in FIG. 7.

The beam pattern illustrated in FIG. 8 may be formed toward the parasitic patch element connected with one reactance element of which the reactance value varies or in the direction between two parasitic patch elements connected with two reactance elements of which the reactance values vary like reference numerals 820 to 890.

However, in the ESPAR antenna of FIGS. 2 and 4, since the beam is radiated while the partial shape of the parasitic patch element, for example, the arrow shape of the arrow is repeatedly arrayed in a predetermined direction, a beam pattern of which a gain is larger than that of the beam pattern of FIG. 7 may be formed.

FIG. 9 is a diagram illustrating a beam pattern of the ESPAR antenna corresponding to FIGS. 5 and 6 and illustrates a beam pattern of a dual polarized ESPAR antenna.

In the ESPAR antenna of FIGS. 5 and 6, when a reactance value of at least one of the plurality of reactance elements varies on the substrate 310, the beam pattern may be formed toward a parasitic patch element connected with the corresponding reactance element or in a direction between parasitic patch elements connected with reactance elements of which reactance values vary.

In this case, in the ESPAR antenna of FIGS. 5 and 6, the feeding line may be vertically connected to the active patch radiator on a line connecting two parasitic patch elements disposed to face each other based on the central position of the active patch radiator. In this case, in the ESPAR antenna, when the signal is applied through the corresponding feeding line, a polarized beam pattern may be formed based on a direction which both ends of the line connecting two parasitic patch elements face.

As an example, in the ESPAR antenna of FIGS. 5 and 6, when the signal is applied to the feeding unit on a line connecting the left and right-direction (x-axis direction) parasitic patch elements, a horizontally polarized beam pattern may be formed in the x-axis direction like reference numeral 910 of FIG. 9. In the ESPAR antenna of FIGS. 5 and 6, when the signal is applied to the feeding unit on a line connecting the top and bottom-direction (y-axis direction) parasitic patch elements, a vertically polarized beam pattern may be formed in the y-axis direction like reference numeral 920 of FIG. 9.

In the ESPAR antenna of FIGS. 5 and 6, when the signal is applied to the feeding unit on a line connecting the top left and bottom right-direction (y'-axis direction) parasitic patch elements, a diagonally polarized beam pattern may be formed in the y'-axis direction like reference numeral 930 of FIG. 9. Further, in the ESPAR antenna of FIGS. 5 and 6, when the signal is applied to the feeding unit on a line connecting the bottom left and top right-direction (x'-axis direction) parasitic patch elements, the diagonally polarized beam pattern may be formed in the x'-axis direction like reference numeral 940 of FIG. 9.

Of course, in the ESPAR antenna of FIGS. 5 and 6, a plurality of polarized beam patterns may be formed according to the positions and the number of connected feeding lines.

FIG. 10 is a diagram illustrating a configuration of a beam forming apparatus to which the ESPAR antenna according to the present invention is applied.

Referring to FIG. 10, the beam forming apparatus according to the present invention may include an ESPAR antenna 1100 and a signal control unit 1200.

Herein, the ESPAR antenna 1100 may correspond to the ESPAR antenna described in FIGS. 1 to 9. Therefore, a duplicative description of the detailed components of the ESPAR antenna 1100 and functions thereof will be omitted.

The signal control unit 1200 may control an operation of a reactance element of the antenna 1100. In this case, the signal control unit 1200 may change the reactance value of the reactance element by controlling a switch and/or an RF diode connected with the reactance element of the antenna 1100. Herein, the signal control unit 1200 may change the reactance value of at least one of a plurality of reactance elements included in the antenna 1100 according to characteristics of transmitted and received signals.

The signal control unit 1200 may control the parasitic patch element to operate as the derivative or the reflector by controlling a switch on/off operation of the parasitic patch element included in the antenna 1100. In this case, the signal control unit 1200 turns off a switch of at least one of a plurality of parasitic patch elements according to the characteristics of the transmitted and received signals to control the corresponding parasitic patch element to operate as the derivative and turns on switches of the residual parasitic patchelements to control the corresponding parasitic patch elements to operate as the reflector.

Therefore, the antenna 1100 may form a beam in a specific direction by the control operation of the signal control unit 1200.

Herein, the signal control unit 1200 may be implemented as an independent hardware device or as one processor among processors of a computing system. The processor may be a central processing unit (CPU) or a semiconductor device executing processing of commands stored in a memory.

Meanwhile, although not illustrated in FIG. 10, the beam forming apparatus may further include a memory storing data and programs for a beam control operation.

Herein, the memory may include various types of volatile or non-volatile storage media. For example, the memory may include a read only memory (ROM) and a random access memory (RAM).

The above description just illustrates the technical spirit of the present inventionand various modifications and transformations can be made by those skilled in the art without departing from an essential characteristic of the present invention.

Accordingly, the exemplary embodiments disclosed herein are intended to not limit but describe the technical spirit of the present invention but the scope of the technical spirit of the present inventionis not limited by the exemplary embodiments. The scope of the present invention should be interpreted by the appended claims and all technical spirit in the equivalent range thereto should be interpreted to be embraced by the claims of the present invention.

What is claimed is:

1. An ESPAR antenna comprising:

an active patch radiator disposed at the center of one surface of a substrate to radiate a beam corresponding to a signal applied through a feeding line;

a plurality of parasitic patch elements disposed to have a predetermined angle in different directions, respectively, based on a central position of the active patch radiator to derive the beam radiated by the active patch radiator in a predetermined direction; and a reactance element disposed between the active patch radiator and the plurality of parasitic patch elements to determine a direction of the beam radiated by the active patch radiator, wherein the plurality of parasitic patch elements is disposed to be inserted in a central direction of the active patch radiator from the outside of the active patch radiator.

2. The ESPAR antenna of claim 1, wherein in the active patch radiator, a slit into which a part of each parasitic patch element is inserted is formed at a partial area of a periphery forming an exterior of the active patch radiator.

3. The ESPAR antenna of claim 1, wherein the slit is formed to be wider than the exterior of the partial parasitic patch element inserted into the partial area of the periphery forming the exterior of the active patch radiator.

4. The ESPAR antenna of claim 1, wherein the plurality of parasitic patch elements is inserted to be spaced apart from each slit formed at the partial area of the periphery forming the exterior of the active patch radiator by a predetermined interval.

5. The ESPAR antenna of claim 1, wherein the reactance element includes a reactance variable circuit, and the active patch radiator radiates the beam in a direction in which a parasitic patch element connected with any one reactance element in which a reactance value of the reactance variable circuit varies among a plurality of reactance elements is positioned.

6. The ESPAR antenna of claim 1, wherein the reactance element includes the reactance variable circuit, and the active patch radiator radiates the beam in any one direction between parasitic patch elements connected with at least two reactance elements in which the reactance value of the reactance variable circuit varies among the plurality of reactance elements.

7. The ESPAR antenna of claim 1, wherein the parasitic patch element connected with the reactance element in which the reactance value of the reactance variable circuit among the plurality of parasitic patch elements varies operates as a derivative and the residual parasitic elements operate as a reflector.

8. The ESPAR antenna of claim 1, wherein the plurality of parasitic patch elements is disposed at a position where a distance between the central position of each parasitic patch element and the central position of the active patch radiator becomes any one of $\lambda/32$ to $\lambda/4$ of an operating frequency of the corresponding antenna.

9. The ESPAR antenna of claim 1, wherein in the plurality of parasitic patch elements, patches having a partial shape of the corresponding parasitic patch element are repeatedly arrayed based on a predetermined direction.

10. The ESPAR antenna of claim 1, wherein in the active patch radiator, the feeding line is vertically connected to the active patch radiator on a line connecting two parasitic patch elements disposed to face each other based on the central position of the active patch radiator and when the signal is applied through the feeding line, a polarized beam pattern is formed based on a direction which both ends of the line connecting two parasitic patch elements face.

11. The ESPAR antenna of claim 1, wherein in the active patch radiator, the feeding line is vertically connected to two lines which are orthogonal to each other among lines connecting two parasitic patch elements disposed to face each other based on the central position of the active patch radiator and when the signal is applied through the feeding line connected to the two lines, a dual polarized beam pattern is formed based on directions which both ends of each lineconnecting two parasitic patch elements face.

12. The ESPAR antenna of claim 1, wherein the plurality of parasitic patch elements is disposed in two or more directions facing each other, respectively based on the central position of the active patch radiator.

13. The ESPAR antenna of claim 1, wherein the active patch radiator is implemented in any one shape of circular and polygonal shapes.

14. The ESPAR antenna of claim 1, wherein the plurality of parasitic patch elements is implemented in any one shape of an arrow, an oval, a rectangle, and the polygonal shape other than the rectangular shape.

15. A beam forming apparatus comprising:

an ESPAR antenna of claim 1; and a signal control unit controlling a pattern of a beam radiated by the ESPAR antenna by controlling a reactance value of at least one reactance element included in the ESPAR antenna and an on or off operation of at least one parasitic patch element.

* * * * *